US011259115B2

(12) United States Patent
Gumerov et al.

(10) Patent No.: US 11,259,115 B2
(45) Date of Patent: Feb. 22, 2022

(54) SYSTEMS AND METHODS FOR ANALYZING MULTICHANNEL WAVE INPUTS

(71) Applicant: VisiSonics Corporation, College Park, MD (US)

(72) Inventors: Nail A. Gumerov, Elkridge, MD (US); Bowen Zhi, College Park, MD (US); Ramani Duraiswami, Highland, MD (US)

(73) Assignee: VisiSonics Corporation, College Park, MD (US)

( * ) Notice: Subject to any disclaimer, the term of this patent is extended or adjusted under 35 U.S.C. 154(b) by 0 days.

(21) Appl. No.: 16/759,237

(22) PCT Filed: Oct. 26, 2018

(86) PCT No.: PCT/US2018/057816
§ 371 (c)(1),
(2) Date: Apr. 24, 2020

(87) PCT Pub. No.: WO2019/084471
PCT Pub. Date: May 2, 2019

(65) Prior Publication Data

US 2020/0359130 A1 Nov. 12, 2020

Related U.S. Application Data

(60) Provisional application No. 62/578,180, filed on Oct. 27, 2017.

(51) Int. Cl.
*H04R 1/40* (2006.01)
*H04R 3/00* (2006.01)
(Continued)

(52) U.S. Cl.
CPC ..... *H04R 1/406* (2013.01); *H04R 3/005* (2013.01); *H04R 3/02* (2013.01); *H04S 3/02* (2013.01); *H04R 2430/21* (2013.01)

(58) Field of Classification Search
CPC .... H04R 3/005; H04R 1/406; H04R 2430/21; H04R 3/02; H04R 2430/20;
(Continued)

(56) References Cited

U.S. PATENT DOCUMENTS 5,434,869 A 7/1995 Maekawa et al.
5,793,875 A * 8/1998 Lehr ..... H04R 25/554 381/313
(Continued)

OTHER PUBLICATIONS

International Search Report dated Feb. 7, 2019 received in corresponding International Application No. PCT/US2018/057816, 2 pages.
(Continued)

*Primary Examiner* — Lun-See Lao
(74) *Attorney, Agent, or Firm* — Foley & Lardner LLP

(57) ABSTRACT

A spatial-audio recording system includes a processor, and instructions stored in a computer-readable medium that, when read by the processor, cause the processor to perform operations. The operations include retrieving audio data recorded at a number of microphones, determining a recorded signal vector based on the audio data, and initializing values for an operator. The operations further include determining a plurality of waves from directions by performing operations comprising iteratively, until an exit condition is satisfied: initializing or incrementing an index "i"; determining an ith direction using the operator; and updating the operator to correspond to the ith iteration.

19 Claims, 10 Drawing Sheets

(51) Int. Cl.
*H04R 3/02* (2006.01)
*H04S 3/02* (2006.01)

(58) Field of Classification Search
CPC ..... G10L 21/0272; G10L 19/008; G10L 21/0232; G10L 19/0204; G10L 19/025; G10L 19/167; G10L 2021/02166; G10L 21/028; G10L 15/02; G10L 19/24; G10L 15/08; G10L 15/20; G10L 2021/02082; G10L 21/003; G10L 21/0216; G10L 25/48; G10L 19/00; G10L 19/032; G10L 19/038; G10L 19/26; G10L 25/63; H04S 2420/03; H04S 7/301; H04S 7/30; H04S 2400/15; H04S 2420/11; H04S 3/002; H04S 3/008; H04S 3/02; H04S 2400/11; H04N 21/26606; H04N 21/435; H04N 21/235; H04N 21/25816; H04N 21/26291; H04N 21/4432; H04N 21/6583; H04N 21/8193; H04N 7/17318; H04N 9/73; H04N 1/0058; H04N 1/00981; H04N 1/00989; H04N 1/2112; H04N 1/32358; H04N 21/4131; H04N 21/426; H04N 21/4351; H04N 21/44008; H04N 21/443; H04N 21/4623; H04N 21/8166; H04N 2201/0084; H04N 5/4401; H04N 5/58; H04N 7/012; H04N 7/0132; H04M 11/04; H04M 1/72418; H04M 1/72454; H04M 2242/04; H04M 2250/22; H04M 3/42153; H04M 3/5116; H04B 11/00; H04B 14/08; H04B 7/185
USPC ..... 381/92, 56–58; 700/94
See application file for complete search history.

(56) References Cited

U.S. PATENT DOCUMENTS

2005/0195988 A1 9/2005 Tashev et al.
2006/0115103 A1* 6/2006 Feng ..... H04R 3/005 381/313
2007/0110290 A1* 5/2007 Chang ..... G06T 5/001 382/128
2014/0328487 A1* 11/2014 Hiroe ..... G10L 21/0272 381/56

OTHER PUBLICATIONS

Written Opinion of the International Searching Authority dated Feb. 7, 2019 received in corresponding International Application No. PCT/US2018/057816, 7 pages.
International Preliminary Report on Patentability dated May 7, 2020 in PCT International Application No. PCT/US2018/057816, 8 pages.

* cited by examiner

MUSIC

SDD

MUSIC

SDD

SYSTEMS AND METHODS FOR ANALYZING MULTICHANNEL WAVE INPUTS

CROSS-REFERENCE TO RELATED APPLICATIONS

The present application is a U.S. National Stage of International Application No. PCT/US2018/057816 filed on Oct. 26, 2018, which claims the benefit of U.S. Provisional Patent Application No. 62/578,180 filed on Oct. 27, 2017, the entire disclosures of all of which are incorporated herein by reference.

BACKGROUND

The present application relates to devices and methods for locating one or more wave sources (e.g., of an audio signal) using improved processing techniques that provide for faster and/or more accurate analysis that can involve a lower computing resource burden than some comparative systems.

Some systems decompose wave signals received by a detector array, and determine locations and/or directions of sources of the wave signals. However, it can be computationally expensive, in term of computing resources, to perform such decomposition.

SUMMARY

The present disclosure describes systems and methods for locating one or more sources of a wave signal, for determining a direction of the wave signal (e.g., relative to a detector array), and for determining a strength or amplitude of the wave signal. This analysis can be performed on multichannel signal data received by multiple inputs of a detector array. The systems and methods described herein provide for a technical improvement to signal processing that implements fast and computationally efficient signal analysis. For example, the systems and methods can make use of previously calculated and stored operators in an iterative process to determine directions corresponding to wave sources relative to a detector array. The determined directions can be used, for example, to isolate, from signal data recorded by the detector array, one of the signal sources and to output a signal that corresponds to the isolated signal source, or can be used to provide data indicative of one or more of the directions to a display that can indicate a direction of a corresponding signal source via a visual indicator. The systems and methods described herein can be used to analyze any appropriate type of wave signal, including audio signals, radar signals, radio signals, or other electromagnetic signals.

In one embodiment, a spatial-audio recording system includes a processor and instructions stored in a computer-readable medium that, when read by the processor, cause the processor to perform certain operations. The operations include retrieving audio data, determining a recorded signal vector based on the audio data, and initializing values for an operator specific to a frequency. The operations further include determining a plurality of directions corresponding by iteratively, until an exit condition is satisfied, performing operations that include: initializing or incrementing an index "i", determining an ith direction using the operator, and updating the operator to correspond to an ith iteration.

In another embodiment, a spatial-audio recording system includes a plurality of microphones comprising a number M of microphones, a processor, and instructions stored in a computer-readable medium that, when read by the processor, cause the processor to perform certain operations. The operations include retrieving audio data recorded by the microphones, determining a recorded signal vector based on the audio data, and initializing values for an operator, the operator being an M×M matrix. The operations further include determining a plurality of directions by performing operations that include iteratively, until an exit condition is satisfied: initializing or incrementing an index "i", determining an ith direction using the operator, and updating the operator to correspond to an ith iteration.

In another embodiment, a method of determining one or more sources of an audio signal includes retrieving audio data, determining a recorded signal vector based on the audio data, and initializing values for an operator. The method further includes determining a plurality of directions by performing operations including iteratively, until an exit condition is satisfied: initializing or incrementing an index "i", determining an ith direction using the operator, and updating the operator to correspond to an ith iteration.

In another embodiment, a spatial-wave analysis system includes a processor and instructions stored in a non-transient computer-readable medium that, when read by the processor, cause the processor to perform certain operations. The operations include retrieving wave signal data, determining a signal vector based on the wave signal data, and initializing values for an operator specific to a frequency. The operations further include determining a plurality of directions by performing operations including iteratively, until an exit condition is satisfied: initializing or incrementing an index "i", determining an ith direction using the operator, and updating the operator to correspond to an ith iteration. The operations yet further include determining an isolated wave having one direction of the plurality of directions.

DETAILED DESCRIPTION

Figure 1:
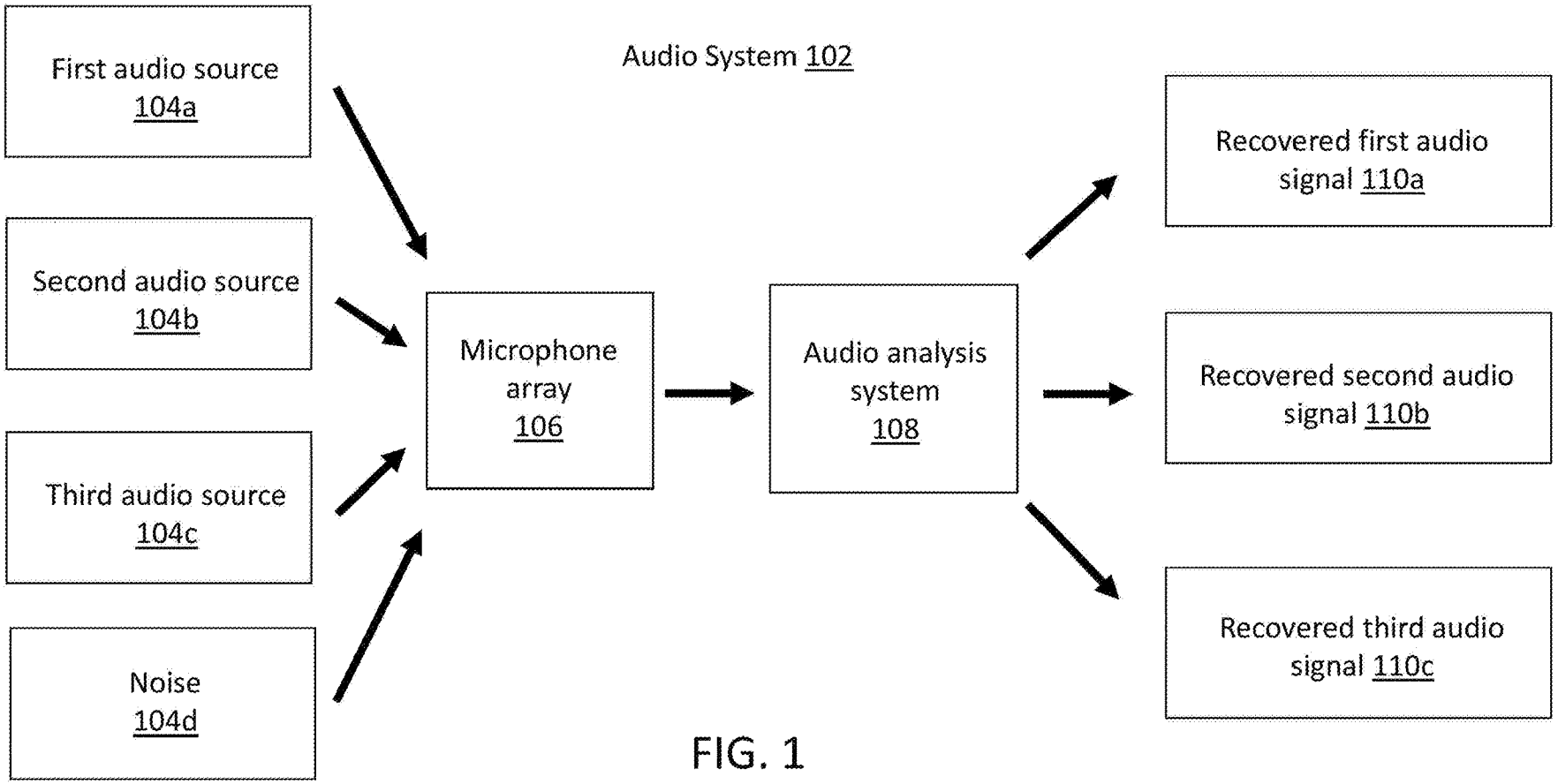
FIG. 1 is a block diagram showing an audio system, according to one or more embodiments.

The present disclosure provides for many different embodiments. While certain embodiments are described below and shown in the drawings, the present disclosure provides only some examples of the principles of described herein and is not intended to limit the broad aspects of the principles of described herein to the embodiments illustrated and described.

Embodiments of the present disclosure provide for determining one or more directions of audio sources based on measurements of an audio field. The determination can be implemented by minimizing a cost-function that is a function of at least one of the directions.

The present disclosure provides for an algorithm for the decomposition of a wave field (e.g., a broadband sound field) into its component plane-waves, and for determining respective directions and strengths of the plane-waves. The algorithm, which may be referred to herein as "Sequential Direction Detection" (or SDD), decomposes the wave field into L plane waves by recursively minimizing an objective function that determines the plane-wave directions, strengths and the number of plane-waves. A discussion of testing of the algorithm on synthetic and real data is included herein.

A sound field at a point in any environment carries a tremendous amount of information, which is used by a listener to understand source locations, message content, and the size and ambience of the space. It would be useful to decompose the sound into its components for identification, and obtain the location/direction and content of individual source objects, especially in applications recreating real scenes in virtual and augmented reality, where sources are usually broadband. Microphone arrays are often used for this. An issue faced is the lack of algorithms to perform such decompositions reliably. As such, steered beamforming can be used.

Plane-wave decomposition with arrays of special shape, such as spherical/cylindrical, may be considered. However, in these cases the number of sources and their directions are not estimated.

A problem of incident field reconstruction at a location can be approached by imposing the prior that the scene is generated by an unknown number of distant broadband sources, which is collected at a spatially compact microphone array of M microphones. The signal from these sources (or their reflections) arrive at the array and can be modeled as far-field plane-waves incident from various directions. Imposing this prior, a formulation can be developed for identifying the incoming plane-wave directions via computing a cost function based on those frequencies for which the array theoretically exhibits no aliasing. A sequential operator formulation can be employed which identifies successively the leading order plane-waves. After identifying the directions, a plane-wave representation can be built over the entire audible frequency range for these directions. Results from synthetic experiments are presented, along with a real demonstration.

Problem Statement

A discussion of one of the problems addressed by the present solutions is provided below. Consider a broadband acoustic field received at an array of M sensors (microphones). The field is assumed to be created by an unknown number of plane-waves L (e.g., plane-waves having to-be-determined directions and strengths). After converting a frame of data to the frequency domain, assume that there are N frequencies, and the field at each frequency at a point r is $$p_n(r) = \sum_{l=1}^{L} A_{nl} e^{-ik_n s_l \cdot r},\ k_n = \frac{\omega_n}{c},\ n = 1, \ldots, N,$$

where $s_l$ are the directions of arrival (DOA), $\omega_n$ are the circular frequencies with wave-numbers $k_n$, and $A_{nl}$ the complex amplitudes. For microphone locations $r_1, \ldots, r_M$, the system of equations describing microphone readings can be written in the form $$\Sigma_{l=1}^{L} A_{nl} e^{-ik_n s_l \cdot r_m} = p_n(r_m), m=1, \ldots, M, n=1, \ldots, N, \tag{2}$$

or in matrix-vector form $$H_n A_n = P_n, n=1, \ldots, N, \tag{3}$$

where $H_n$ is a M×L matrix with entries $(H_n)_{ml} = e^{-ik_n s_l \cdot r_m}$, $A_n$ a L vector with entries $(A_n)_l = A_{nl}$, and $P_n$ the M vector with entries $(P_n)_m = p_n(r_m)$. Then $$H_n = (h_n(s_1) h_n(s_2) \ldots h_n(s_L)), \tag{4}$$

where $h_n(s_l)$ are M vectors, known as "steering" vectors, while $H_n$ is called the "steering matrix". The steering matrix can be modified to account for scattering from the objects holding the microphone array. In this case its entries $(H_n)_{ml}$ can be taken as object-related transfer functions, similar to the head related transfer function (HRTF).

One problem can be set forth as follows: given $P_n$, determine L, the DOA $s_1, \ldots, s_L$, and amplitudes $\{A_{nl}\}$. The field in Equation (1) (Eq. 1) is characterized by NL complex amplitudes $A_{nl}$ and L unit vectors $s_l$, or 2(N+1)L real unknowns for 3D (two angles/direction) and (2N+1)L unknowns in 2D (one angle/direction). Directions are assumed to be consistent across frequencies (e.g. it is assumed that sources are broadband). The microphone readings provide NM complex numbers $p_{mn}$ which yield 2NM equations using Eq. 2 and Eq. 3. The system can be solved if $$L \le \frac{MN}{N+1} < M, \text{ in } \mathbb{R}^3,\ L \le \frac{2MN}{2N+1} < M, \text{ in } \mathbb{R}^2. \tag{5}$$

This shows that as the number of frequencies N (or bandwidth) increases, the number of detectable DOA also increases. Regardless, L is smaller than the number of microphones M.

Sequential Direction Detection Algorithm

The solution of Eq. 3 can be sought by globally minimizing a suitable cost function based on discrepancy between measured and predicted data with respect to $\{A_n\}$ and $\{s_l\}$, in a suitable norm such as $L_2$, $$\mathcal{F} = \Sigma_{n=1}^{N} w_n \|H_n A_n - P_n\|_2^2 \rightarrow \min, \tag{6}$$

where $w_n$ are some positive weights (e.g. $w_n=1$, n=1, . . . , N).

Note that $\{s_l\}$ determines $H_n$. Hence, the minimum of the functional of Eq. 6 can be achieved when the amplitudes $A_n$ are related to $P_n$ via minimization for a given $H_n$, which in $L_2$ is $$A_n = (H_n^* H_n)^{-1} H_n^* P_n, n=1, \ldots, N, \tag{7}$$

where $H_n^*$ is the transpose conjugate of $H_n$ and it is assumed that $H_n^* H_n$ is pseudo-invertible. On the other hand, this relation determines the optimal $A_n$ as functions of directions $\{s_l\}$. Substituting Eq. (7) into Eq. (6), it can be seen that the number of independent variables for the objective function reduces to L directions $s_l$, and that $$\mathcal{F}(s_1, \ldots, s_L) = \sum_{n=1}^{N} w_n \mathcal{F}_n, \tag{8}$$

$$\mathcal{F}_n = \|(H_n(H_n^* H_n)^{-1} H_n^* - I)P_n\|_2^2,$$

where I is the L×L identity matrix.

Despite the reduction in the dimensionality at this stage by only considering directions (from 2(N+1)L to 2L in 3D, and (2N+1)L to L in 2D), nonlinear optimization is still expensive in L dimensions. Further, multiple local minima complicate the search for the global minimum. Herein is proposed a method for approximate determination of the directions, which has a relatively low computational complexity. Assume $$s \neq t, \Rightarrow h_n(s) \neq h_n(t), n=1, \ldots, N. \tag{9}$$

SDD constructs steering matrices $H_n$ via consequent determination of optimal directions $s_1, s_2, \ldots$ terminated by an exit criteria. At the lth step the M×l steering matrix, which is a function of s, is $$H_n^{(l)}(s) = (h_n^{(l)} \ldots h_n^{(l-1)} h_n(s)). \tag{10}$$

Here $h_n^{(k)} = h_n(s_k)$, k=1, . . . , l−1, are constants, as the directions $s_1, \ldots, s_{l-1}$ are determined at earlier steps. Consider then the objective function $\mathcal{F}^{(l)}(s)$, $$\mathcal{F}^{(l)}(s) = \sum_{n=1}^{N} w_n \mathcal{F}_n^{(l)}(s), \tag{11}$$

$$\mathcal{F}_n^{(l)} = \left\|\left(H_n^{(l)}(H_n^{(l)*} H_n^{(l)})^{-1} H_n^{(l)*} - I\right)P_n\right\|_2^2,$$

which is globally minimized at $s=s_l$ and continue recursively, assigning $h_n^{(l)} = h_n(s_l)$ and setting the steering matrix $H_n^{(l)}(s_l)$ at the lth iteration to $H_n$. The iteration terminates at l=M−1 or $$\epsilon^{(l)} = \left(\frac{\mathcal{F}^{(l)}(s_l)}{\sum_{n=1}^{N} w_n \|P_n\|_2^2}\right)^{1/2} < \epsilon_{tol}, \tag{12}$$

where $\epsilon_{tol}$ is the tolerance and $\epsilon^{(l)}$ is the relative error in the $L_2$ norm, for $H_n = H_n^{(l)}(s_l)$).

Consider now the first step of the algorithm at which $s_1$ can be determined. This corresponds to a guess that the field is generated by one plane wave. Then $H_n^{(1)}(s)$ has size M×1 and consists of one vector $h_n(s)$. The objective function for the first step is, $$\mathcal{F}^{(l)}(s) = \sum_{n=1}^{N} w_n \mathcal{F}_n^{(1)}(s), \mathcal{F}_n^{(1)}(s) = P_n^*\left(I - \frac{h_n(s)h_n^*(s)}{h_n^*(s)h_n(s)}\right)P_n. \tag{13}$$

The global minimum of any $\mathcal{F}^{(l)}(s)$ over the two angles (in 3D) or one angle (in 2D) is relatively easily found, (e.g., using gradient methods). Denote the minimum as $s_l$ and check if the incident field is well approximated by l plane-waves using Eq. (12). If l<M−1 and condition (12) does not hold the process advances to the l+1th step.

Recursion for SDD Operators

The computational complexity of the implementation using Eqs. (10) and (11) directly increases with l. This is due to several matrix-matrix multiplications and matrix inversion operations, which cost $O(l^3)+O(M^2)$ for the lth step. This can be reduced to $O(M^2)$ using a recursive process for generating the SDD operators, namely M×M matrices $L_n^{(l)}(s)$, $$L_n^{(l)}(s) = I - H_n^{(l)}(s) G_n^{(l)}(s) H_n^{(l)*}(s), \tag{14}$$

where $$G_n^{(l)}(s) = (H_n^{(l)*}(s) H_n^{(l)}(s))^{-1}. \tag{15}$$

The objective function for the lth step takes the form $$\mathcal{F}^{(l)}(s) = \Sigma_{n=1}^{N} w_n \|L_n^{(l)}(s)P_n\|_2^2 = \Sigma_{n=1}^{N} w_n P_n^* L_n^{(l)}(s) P_n. \tag{16}$$

For constant matrices computed at step l−1 the notation $L_n^{(l-1)} = L_n^{(l-1)}(s_{l-1})$, $G_n^{(l-1)} = G_n^{(l-1)}(s_{l-1})$, and $H_n^{(l-1)} = H_n^{(l-1)}(s_{(l-1)})$ will be used. Also, for brevity, the argument s of matrix functions $L_n^{(l)}$, $G_n^{(l)}$, $H_n^{(l)}$, and vector function h, is dropped. Representing $$H_n^{(l)} = (H_n^{(l-1)} h_n), \tag{17}$$

provides $$G_n^{(l)} = \begin{pmatrix} (G_n^{(l-1)})^{-1} & H_n^{(l-1)*} h_n \\ h_n^* H_n^{(l-1)} & h_n^* h_n \end{pmatrix}^{-1}, \tag{18}$$

and $((G_n^{(l-1)})^{-1} = H_n^{(l-1)*} H_n^{(l-1)})$. Using the following formula for an arbitrary (invertible) block matrix, $$G = \begin{pmatrix} A & B \\ C & D \end{pmatrix}^{-1} = \begin{pmatrix} A^{-1} + A^{-1}BECA^{-1} & -A^{-1}BE \\ -ECA^{-1} & E \end{pmatrix} \tag{19}$$

with $E = (D - CA^{-1}B)^{-1}$. When D is a scalar, E is also a scalar, so $$G = \begin{pmatrix} A^{-1} & 0 \\ 0 & 0 \end{pmatrix} + E\begin{pmatrix} A^{-1}BCA^{-1} & -A^{-1}B \\ -CA^{-1} & 1 \end{pmatrix}. \tag{20}$$

The following can be set:

$$G = G_n^{(l)}, A^{-1} = G_n^{(l-1)}, B = H_n^{(l-1)*} h_n, C = h_n^* H_n^{(l-1)} = B^*,$$

$$E^{-1} = h_n^* h_n - h_n^* H_n^{(l-1)} G_n^{(l-1)} H_n^{(l-1)*} h_n = h_n^* L_n^{(l-1)} h_n. \tag{21}$$

Substituting this into definition (14) and simplifying, one obtains $$L_n^{(l)} = L_n^{(l-1)} - \frac{L_n^{(l-1)} h_n h_n^* L_n^{(l-1)}}{h_n^* L_n^{(l-1)} h_n}, \; l = 1, 2, \ldots \tag{22}$$

For l=1, set $L_n^{(0)}=1$. Eq. (22) involves using stored or previously determined constant matrices $L_n^{(l-1)}$ to compute $\mathcal{F}^{(l)}(s)$ (see Eq. (16)), which thus requires only a few M matrix-vector multiplications. As soon as the optimal direction $s_l$ is found, the constant matrix $L_n^{(l)}(s_l)$ needed for the (l+1)th iteration can be computed using Eq. (22), also taking $O(M^2)$ operations. The total complexity of the recursive algorithm for the maximum number of steps is $O(M^3)$ as opposed to $O(M^4)$.

Equation (22) reveals a number of features about the SDD algorithm. First, for any s, the steering vector $h_n(s)$ is an eigenvector of $L_n^{(l)}(s)$ corresponding to zero eigenvalue, or belongs to the null-space of $L_n^{(l)}(s)$. Indeed, as immediately follows from Eq. (22), $$L_n^{(l)}h_n = L_n^{(l-1)}h_n - \frac{L_n^{(l-1)}h_n h_n^* L_n^{(l-1)}h_n}{h_n^* L_n^{(i-1)}h_n} = 0. \tag{23}$$

Second, Eq. (22) shows that any eigenvector of $L_n^1$, $l>1$, corresponding to zero eigenvalue will be also eigenvector of $L_n^{(l)}$, so the nullspace of operator $L_n^{(l)}$ includes the nullspace of operator $L_n^{(l-1)}$. Therefore, by induction all vectors $h_n^{(1)}$, $h_n^{(2)}, \ldots, h_n^{(l-1)}$ are the eigenvectors of $L_n$ $(l)$ corresponding to zero eigenvalues.

Third, this shows that for $s=s_{l-1}$, $L_n^{(l)}(s)=L_n^{(l-1)}$ and so $\mathcal{F}^{(i)}(s)=\mathcal{F}^{(l-1)}(s_{l-1})$. Therefore, $\min \mathcal{F}^{(l)}(s) \leq \min \mathcal{F}^{(l-1)})(s)=\mathcal{F}^{(l-1)}(s_{1-1})$ and by induction $$\min \mathcal{F}^{(l)} \leq \ldots \min \mathcal{F}^{(1)} \leq \mathcal{F}^{(0)} \equiv \Sigma_{n=1}^{N} w_n \|P_n\|^2. \tag{23}$$

Strict inequalities can be implemented in Eq. (24). In this case the minimal $\mathcal{F}^{(l)}(s)$ should be at some $s=s_l \neq s_{l-1}$. This also means that all directions found would be distinct.

Fourth, if $s_1, \ldots, s_l$ are all different, the steering vectors $h_n^{(1)} \ldots h_n^{(l)}$ corresponding to these directions are also different (see Eq. (9)). This means that in this case $\text{rank}(L_n^{(l)}(s_l))=M-l$ since the nullspace of $L_n^{(l)}(s_l)$ is $$\ker(L_n^{(l)})=\text{span}(h_n^{(1)}, \ldots, h_n^{(l)}), \dim(\ker(L_n^{(l)}))=l. \tag{24}$$

This shows that $L_n^{(M)}(s)\equiv 0$, $\mathcal{F}^{(l)}(s)\equiv 0$ for any s, consistent with the fact that the maximum number of steps is $l=M-1$.

SDD Algorithm Summary

Define the following M×M matrices $L_n^{(l)}(s)$ and M×1 vectors $l_n^{(l)}(s)$ as functions of direction s:

$$\begin{aligned} &L_n^{(0)}(s) \equiv I, \\ &l_n^{(l)}(s) = L_n^{(l)}(s_l)h_n(s),\ l = 0, 1, 2, \ldots, \\ &L_n^{(l)}(s) = L_n^{(l-1)}(s_{l-1}) - \frac{l_n^{(l-1)}(s)l_n^{(l-1)*}(s)}{l_n^{(l-1)*}(s)l_n^{(l-1)}(s)},\ l = 1, 2, \ldots, \end{aligned} \tag{26}$$

where I is the identity. Define the objective (steering) function as $$\mathcal{F}_n^{(l)}(s)=P_n^* L_n^{(l)}(s)P_n,\ \mathcal{F}^{(l)}(s)=\Sigma_{n=1}^{N} w_n \mathcal{F}_n^{(l)}(s), \tag{27}$$

and the relative norm of the residual $$\epsilon^{(l)} = \left(\frac{\mathcal{F}^{(l)}(s_l)}{\|P\|_2^2}\right)^{1/2},\ \|P\|_2^2 = \sum_{n=1}^{N} w_n \|P_n\|_2^2,\ \|P_n\|_2^2 = P_n^* P_n. \tag{28}$$

One embodiment of the SDD algorithm then is the following:

Set some tolerance, $\epsilon_{tol}<1$,
compute and store $\|P\|^2$
set=0, $\epsilon^{(l)}=1$, $L_n^{(l)}(s_l)=I$.
while $\epsilon^{(l)}>\epsilon_{tol}$ 1. $l=l+1$;
2. find and store $s_l=\arg\min \mathcal{F}_{SDD}^{(l)}(s)$;
3. evaluate $L_n^{(l)}(s_l)$;
4. evaluate $\epsilon^{(l)}$;

$L=l$; the required set of directions is $\{s_1, \ldots, s_l\}$.

Audio Analysis System

Referring now to FIG. 1, FIG. 1 shows an audio system 102 that includes audio sources 104 (including a first audio source 104*a*, a second audio source 104*b*, and a third audio source 104*c*), noise 104*d*, a microphone array 106, an audio analysis system 108, and recovered audio signals 110 (including a recovered first audio signal 110*a*, a recovered second audio signal 110*b*, and a recovered third audio signal 110*c*). In some embodiments, the microphone array 106 is included in the audio analysis system 108. The microphone array 106 can include one or more microphones that detect audio signals emitted by the audio sources 104, as well as the noise 104*d*, which may be background noise. The audio analysis system 108 can retrieve or store the detected audio signals, and can process the signals to determine directions corresponding to respective locations of the audio sources 104 (e.g. relative to the microphone array). The audio analysis system 108 can isolate signals from the audio sources 104 by determining a direction and a strength of detected audio waves to generate the recovered audio signals 110. The audio analysis system 108, as described herein, can implement improved processing techniques that provide for faster and/or more accurate analysis that can involve a lower computing resource burden than some comparative systems.

In one or more embodiments, the audio analysis system 108 can include, for example, an audio generator (e.g. a speaker). The audio analysis system 108 can be configured isolate, from audio data recorded by the microphone array 106, one of the audio sources 104 and can output an audio signal that corresponds to the isolated audio source 104 via the audio generator. In some embodiments, the audio signal can be output to a speech-to-text converter to generate text corresponding to the isolated audio signal. In one or more embodiments, the audio analysis system 108 can include, for example, a display, such as a liquid crystal display (LCD), a thin film transistor LCD (TFT-LCD), a blue phase LCD, an electronic paper (e-ink) display, a flexile display, a light emitting diode display (LED), a digital light processing (DLP) display, a liquid crystal on silicon (LCOS) display, an organic light-emitting diode (OLED) display, a head-mounted display, or a 3D display. The audio analysis system 108 can be configured to determine or provide data indicative of one or more determined directions corresponding to respective locations of the audio sources 104, and the display can display a visual indicator indicative of a direction of corresponding audio sources 104.

Reference is made herein to one or more microphones. However, it is to be understood that other detectors or recording devices can be used in place of, or in addition to, the microphones, as appropriate. For example, an electromagnetic detector array can be used when analyzing radio waves or other electromagnetic waves.

Figure 2:
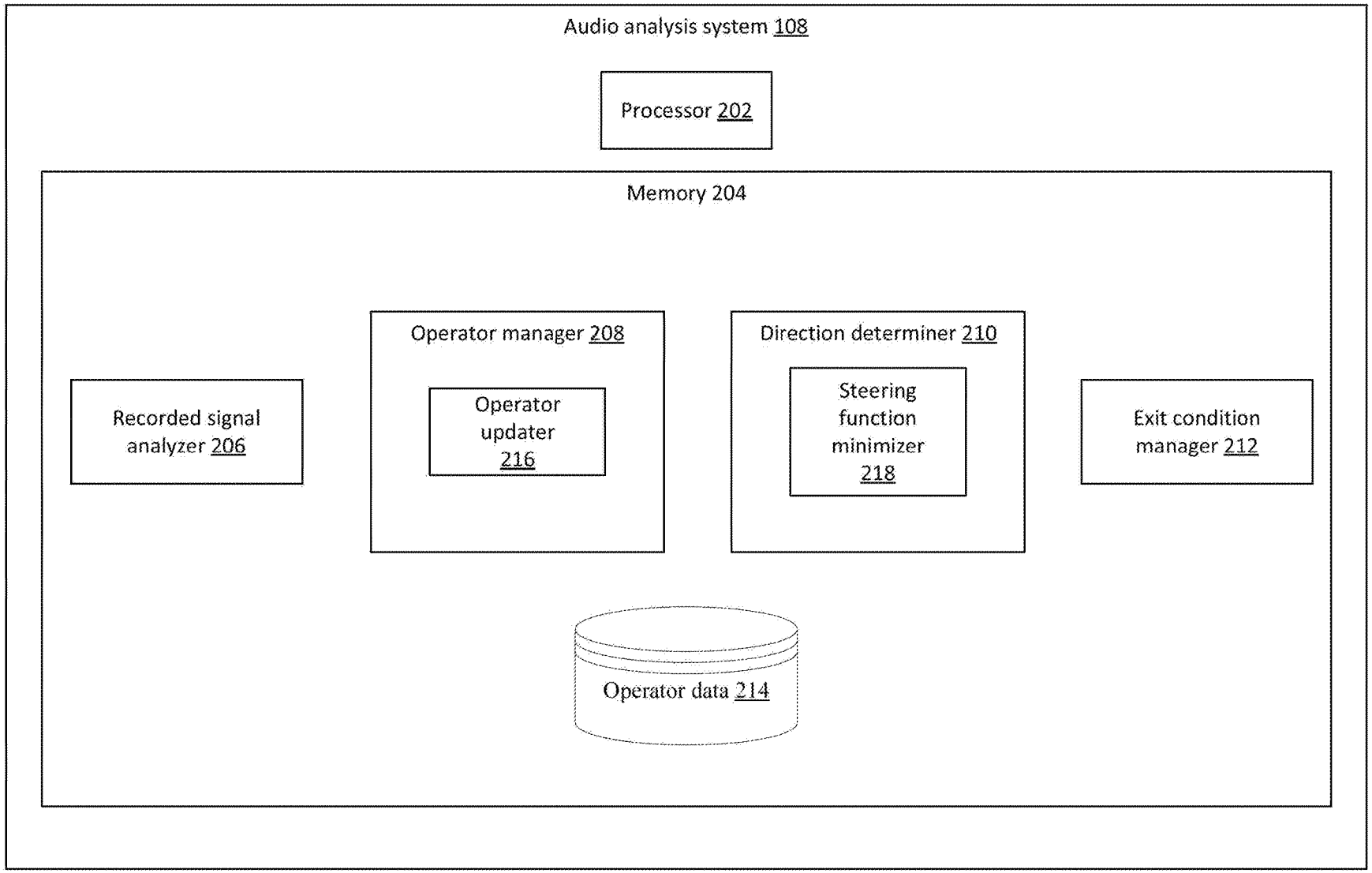
FIG. 2 is a block diagram showing an audio analysis system, according to one or more embodiments.

Referring now to FIG. 2, FIG. 2 shows an embodiment of an audio analysis system 108. The audio analysis system 108 can include a processor 202 and a memory 204. The processor 202 may include a microprocessor, an application-specific integrated circuit (ASIC), a field-programmable gate array (FPGA), etc., or combinations thereof. The memory 204 may store machine instructions that, when executed by a processor 202, cause the processor 202 to perform one or more of the operations described herein. The memory 204 may include, but is not limited to, electronic, optical, magnetic, or any other storage or transmission device capable of providing processor with program instructions. The memory may include a floppy disk, compact disc read-only memory (CD-ROM), digital versatile disc (DVD), magnetic disk, memory chip, read-only memory (ROM), random-access memory (RAM), Electrically Erasable Programmable Read-Only Memory (EEPROM), erasable programmable read only memory (EPROM), flash memory, optical media, or any other suitable memory from which processor can read instructions. The instructions may include code from any suitable computer programming language such as, but not limited to, ActionScript®, C, C++, C#, HTML, Java®, JavaScript®, Perl®, Python®, Visual Basic®, and XML.

The memory 204 can include one or more applications, services, routines, servers, daemons, or other executable logics for analyzing an audio signal, including one or more of a recorded signal analyzer 206, an operator manager 208, a direction determiner 210, and an exit condition manager 212. The memory 204 can also include, access, maintain or manage one or more data structures, including but not limited to operator data 214.

The recorded signal analyzer 206 can include components, subsystems, modules, scripts, applications, or one or more sets of computer-executable instructions for analyzing a recorded signal. The recorded signal analyzer 206 can process one or more signals received by one or more microphones of a microphone array that includes M microphones. The recorded signal analyzer 206 can determine a vector $P_n$ of length M having entries $(P_n)_m=p_n(r_m)$, where $p_n$ is an audio field corresponding to a frequency n (that may be determined by the recorded signal analyzer 206 according to Eq. 1) and $r_m$ indicates an mth microphone location.

The operator manager 208 can include components, subsystems, modules, scripts, applications, or one or more sets of computer-executable instructions for managing an operator, and can include an operator updater 216. The operator manager 208 can determine an operator such as an SDD operator. The SDD operator can be specific to a frequency, and can be an M×M matrix. The operator manager 208 can initialize the SDD operator (e.g. as an identity matrix). The operator updater 216 of the operator manager 208 can iteratively update the SDD operator. For example, the operator updater 216 can iteratively update the SDD operator based on previously determined iterations of the SDD operator (e.g. according to Eq. 22, or according to Eq. 26).

The direction determiner 210 can include components, subsystems, modules, scripts, applications, or one or more sets of computer-executable instructions for determining one or more directions corresponding to an audio signal (e.g. a direction that indicates a location or a direction of a source of the audio signal), and can include an objective function minimizer 216. The direction determiner 210 can determine one or more directions by iteratively minimizing an objective function that is a function of an SDD operator, such as the objective function provided in Eq. 27. The direction determiner 210 can determine at least one direction per iteration. For example, the objective function minimizer 216 can use a most recent iteration of the SDD operator (e.g. corresponding to an (i−1)th iteration) as part of the objective function to be minimized (e.g. according to Eq. 26). The objective function minimizer 216 can retrieve the most recent iteration of the SDD operator from operator data 214, which can store one or more iterations of the SDD operator. The objective function to be minimized can be a function of a direction to be determined, and minimizing the objective function can be performed by determining the direction that minimizes the objective function. Such a minimization process can be performed by the objective function minimizer 216, for example, by implementing a gradient method (e.g. a gradient descent method), or by another suitable minimization process.

Furthermore, the direction determiner 210 can re-estimate the strengths of the already-estimated signals. For example, the direction determiner 210 can update the previously-determined amplitudes $A_n$ by minimizing the cost function provide in Eq. 6 using the newly determined one or more directions. Thus, the estimates of the strengths of isolated signals corresponding to the determined directions can be made more accurate.

The exit condition manager 212 can include components, subsystems, modules, scripts, applications, or one or more sets of computer-executable instructions for managing an exit condition of the iterative process for determining the one or more directions. The exit manager 212 can monitor whether an exit condition is satisfied, and can terminate the iterative process when the exit condition is satisfied. The exit condition can be related to a size of an error or residual, such as the residual provided by Eq. 28. The exit condition can be based on the residual being equal to or lower than a predetermined threshold.

The operator data 214 can include one or more data structures that store data for operators. For example, the operator data 214 can store operators corresponding to different iterations of the operator determined by the operator manager 208. The operator data can include, for example, SDD operators and/or vectors $l_n^{(i)}(s)$, as described herein.

Figure 3:
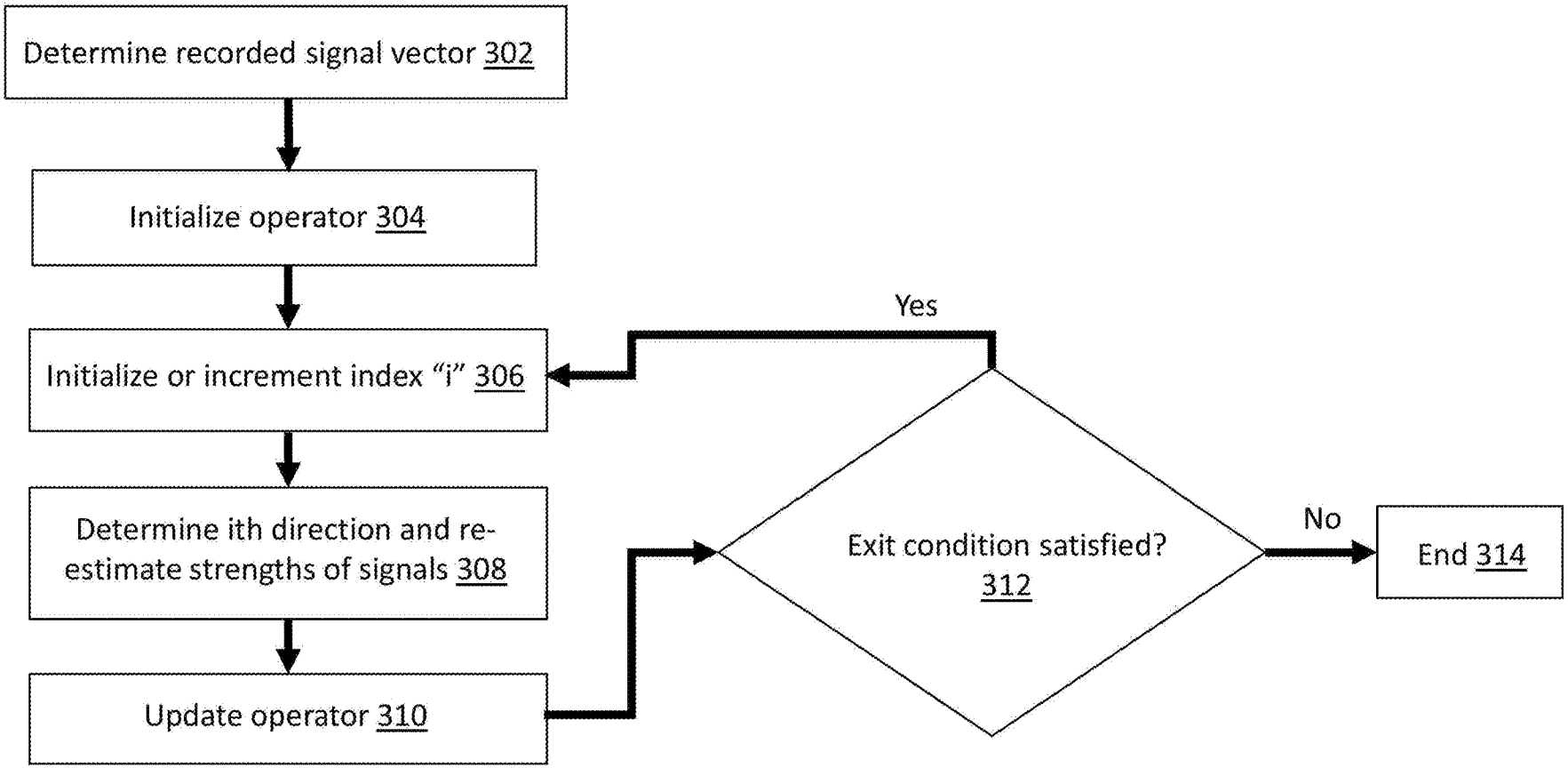
FIG. 3 is a flowchart showing a process for determining directions and strengths of signals, according to one or more embodiments.

Referring now to FIG. 3, FIG. 3 shows a process for determining directions and strengths of signals. The depicted process can be implemented by the audio analysis system 108. In a brief overview, the recorded signal analyzer 206 can determine a recorded signal vector at block 302. The operator manager 208 can initialize an operator at block 304. The direction determiner 210 can initialize or increment an index "i" at block 306. The direction determiner 210 can determine an ith direction and re-estimate strengths of signals at block 308. The operator manager 208 can update the operator at block 310. The exit condition manager 212 can determine whether an exit condition is satisfied at block 312. If the exit condition is not satisfied, the process can proceed to block 306, and the direction determiner 210 can increment the index i. Otherwise, the process can proceed to block 314, and the process ends.

In more detail, at block 302, the recorded signal analyzer 206 can process one or more signals received by one or more microphones of a microphone array that includes M microphones. The recorded signal analyzer 206 can determine a vector P of length M having entries $(P_n)_m=p_n(r_m)$, where $p_n$ is an audio field corresponding to a frequency n (that may be determined by the recorded signal analyzer 206 according to Eq. 1) and $r_m$ indicates an mth microphone location.

At block 304, the operator manager 208 can determine an SDD operator specific to a frequency. For example, the operator manager 208 can initialize the SDD operator as an M×M identity matrix.

At block 306, the direction determiner 210 can initialize or increment an index "i". At block 308, the direction determiner 210 can determine one or more directions by minimizing an objective function that is a function of the SDD operator (e.g. according to Eq. 26). The objective function minimizer 216 can retrieve the most recent iteration of the SDD operator from operator data 214, which can store one or more iterations of the SDD operator. The objective function to be minimized can be a function of a direction to be determined, and minimizing the objective function can be performed by determining the direction that minimizes the objective function. Such a minimization process can be performed by implementing a gradient method (e.g. a gradient descent method), or by another suitable minimization process.

Furthermore, at block 306 the direction determiner 210 can re-estimate the strengths of the already-estimated signals. For example, the direction determiner 210 can update the previously-determined amplitudes $A_n$ by minimizing the cost function provide in Eq. 6 using the newly determined one or more directions. Thus, the estimates of the strengths of isolated signals corresponding to the determined directions can be made more accurate.

At block 310, the operator manager 208 can update the SDD operator. For example, the operator updater 216 can update the SDD operator based on previously determined iterations of the SDD operator (e.g. according to Eq. 22, or according to Eq. 26).

At block 312, the exit condition manager 212 can monitor whether an exit condition is satisfied, and can terminate the iterative process when the exit condition is satisfied. The exit condition can be related to a size of an error or residual, such as the residual provided by Eq. 28. The exit condition can be based on the residual being equal to or lower than a predetermined threshold.

At block 314, the process ends. The audio analysis system 108 can store the determined directions, and/or can perform further analysis on the determined directions.

Figure 4:
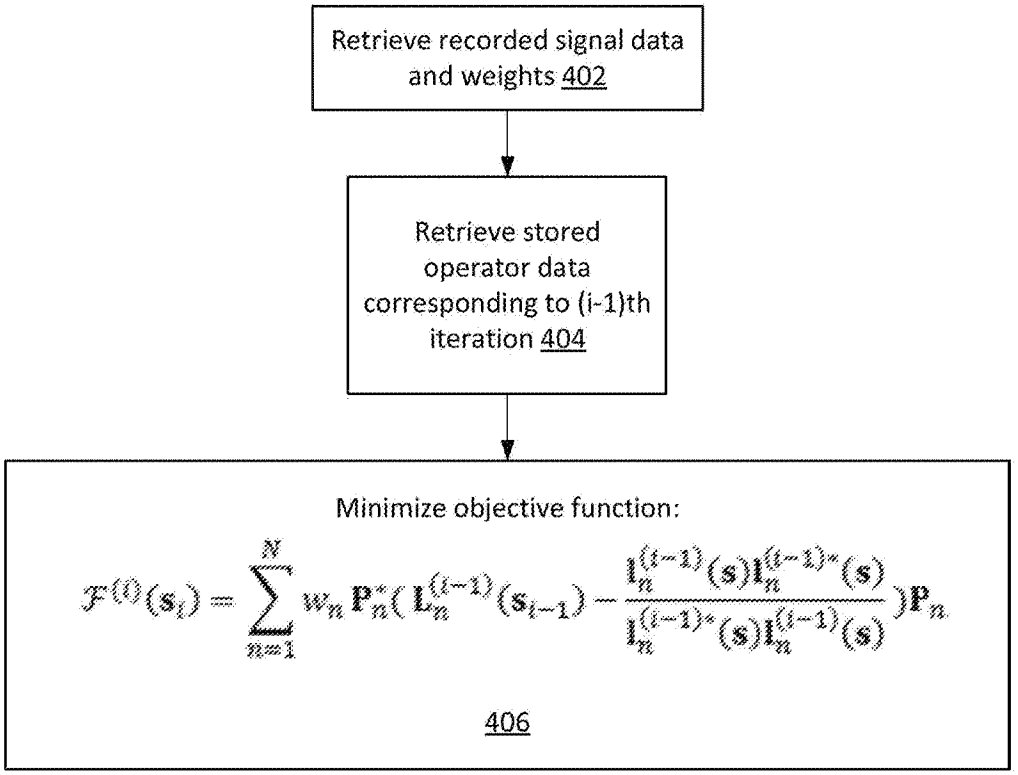
FIG. 4 flowchart showing a process for determining one or more directions, according to one or more embodiments.

Referring now to FIG. 4, FIG. 4 shows a process for determining one or more directions. The process can be performed by the direction determiner 210. In a brief overview, at block 402, the direction determiner 210 can retrieve recorded signal data and weights corresponding to frequencies. At block 404 the direction determiner 210 can retrieve stored operator data corresponding to a (i−1)th iteration of an iterative process. At block 406, the objective function minimizer 218 can minimize an objective function, such as the function:

$$\mathcal{F}^{(i)}(s_i) = \sum_{n=1}^{N} w_n P_n^* \left( L_n^{(i-1)}(s_{i-1}) - \frac{I_n^{(i-1)}(s) I_n^{(i-1)*}(s)}{I_n^{(i-1)*}(s) I_n^{(i-1)}(s)} \right) P_n. \tag{29}$$

In more detail, at block 402, the direction determiner 210 can retrieve recorded signal data and weights corresponding to frequencies. The recorded signal data can be data determined by the recorded signal analyzer 206 by processing one or more signals received by one or more microphones of a microphone array that includes M microphones. The recorded signal data can include a vector $P_n$ of length M having entries $(P_n)_m = p_n(r_m)$, where $p_n$ is an audio field corresponding to a frequency n (that may be determined by the recorded signal analyzer 206 according to Eq. 1) and $r_m$ indicates an mth microphone location.

At block 404, the direction determiner 210 can retrieve stored operator data corresponding to an (i−1)th iteration of an iterative process for determining one or more directions. For example, the stored operator data can be operator data determined by the operator manager 208 and stored as operator data 214.

At block 406, the objective function minimizer 210 can determine a direction that minimizes an objective function, such as the function provided by Eq. 29. The objective function can include, or can be based on (determined from), an operator included in the stored operator data.

Thus, one or more directions can be determined by the direction determiner 210.

Experimental Demonstration

A set of experiments based on simulated and real data are described herein. In each simulation a number of sources were positioned in a virtual room. Only direct paths are considered in simulations. Each source signal was independently generated pink noise. The simulated microphones are omnidirectional and record at 44.1 kHz. Gaussian white noise is added to each simulated recording with SNR of 10 dB.

Herein is described four synthetic experiments, labeled as A, B, C, D, and one real experiment labeled E. In the synthetic experiments, the spectrum functions of MUSIC and SDD are compared, where the SDD spectrum function is the reciprocal of its objective function (though note the SDD is performed over multiple iterations and uses a more complex cost function than what is plotted). In the real experiment, the directions computed by SDD are compared to a "ground truth." The frame size was selected to be 2048. The azimuth and elevation of a source relative to the array center are denoted as (0, 0). Note that MUSIC is given the number of sources present and uses 4 frames of data to perform the modified covariance estimation described in reference [4], while SDD determines the number of sources and uses only one frame.

Figure 5A:
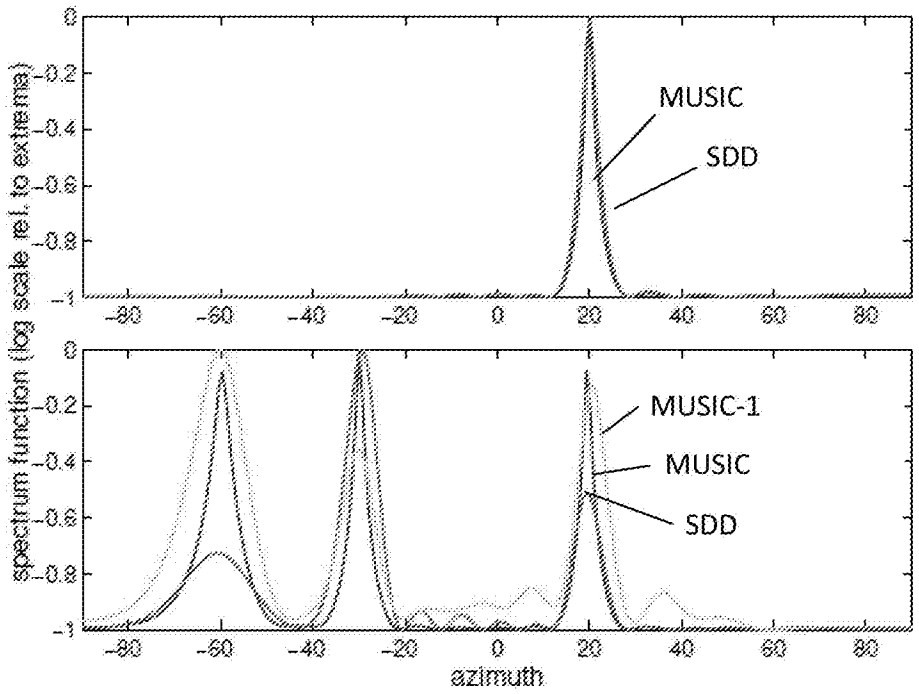
FIG. 5A shows experimental results including initial spectrum functions for two experiments.
Figure 5B:
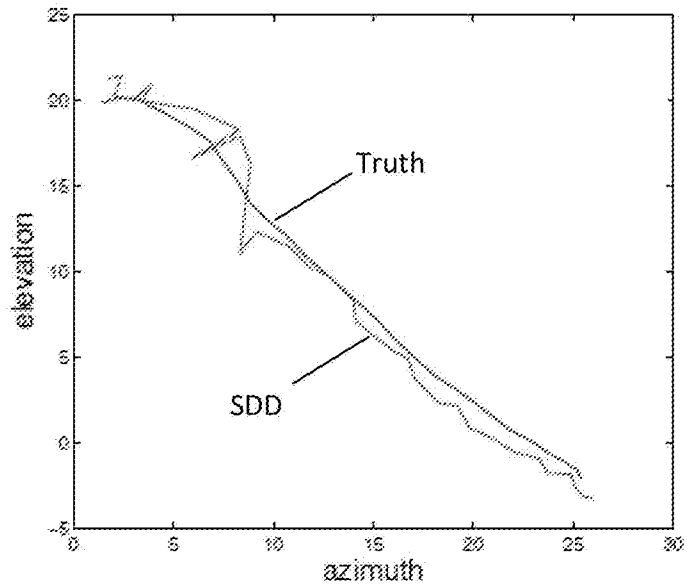
FIG. 5B shows experimental results including parametric plots of "true" and computed audio source directions.
Figure 5C:
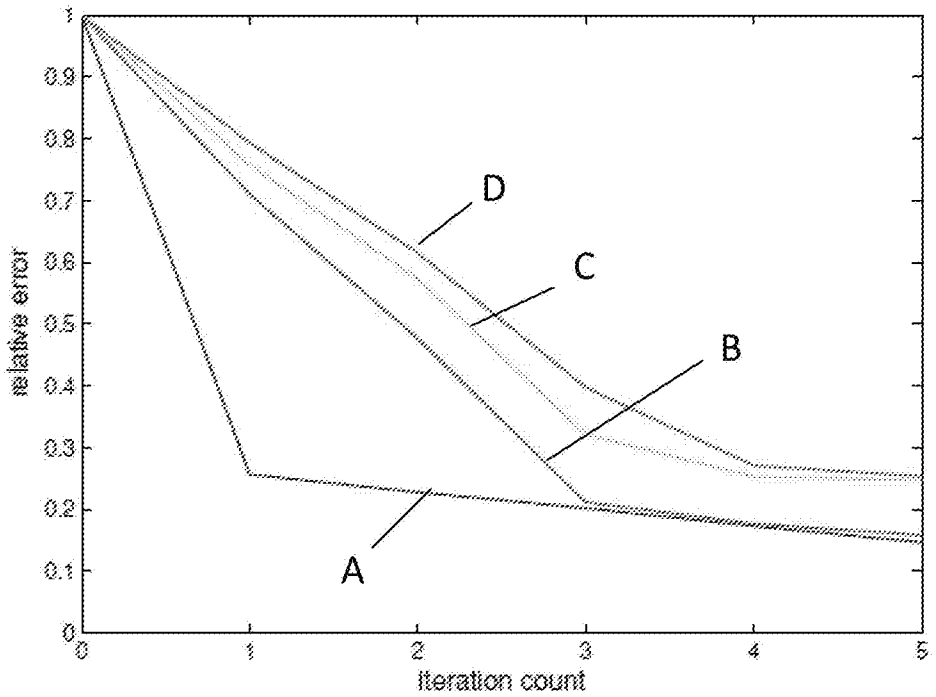
FIG. 5C shows an error or residual for a plurality of iterations of a method described herein used in synthetic experiments.
Figure 6:
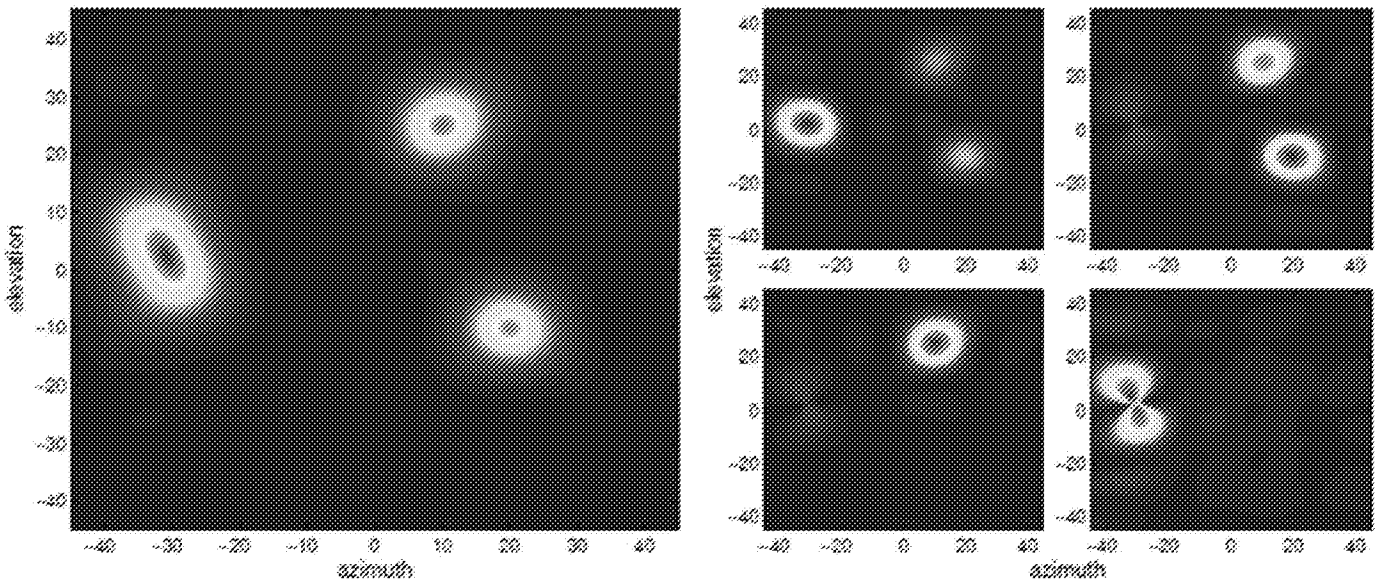
FIG. 6 shows spectrum functions for an experiment displayed as contour plots on a decibel (dB) scale.
Figure 7:
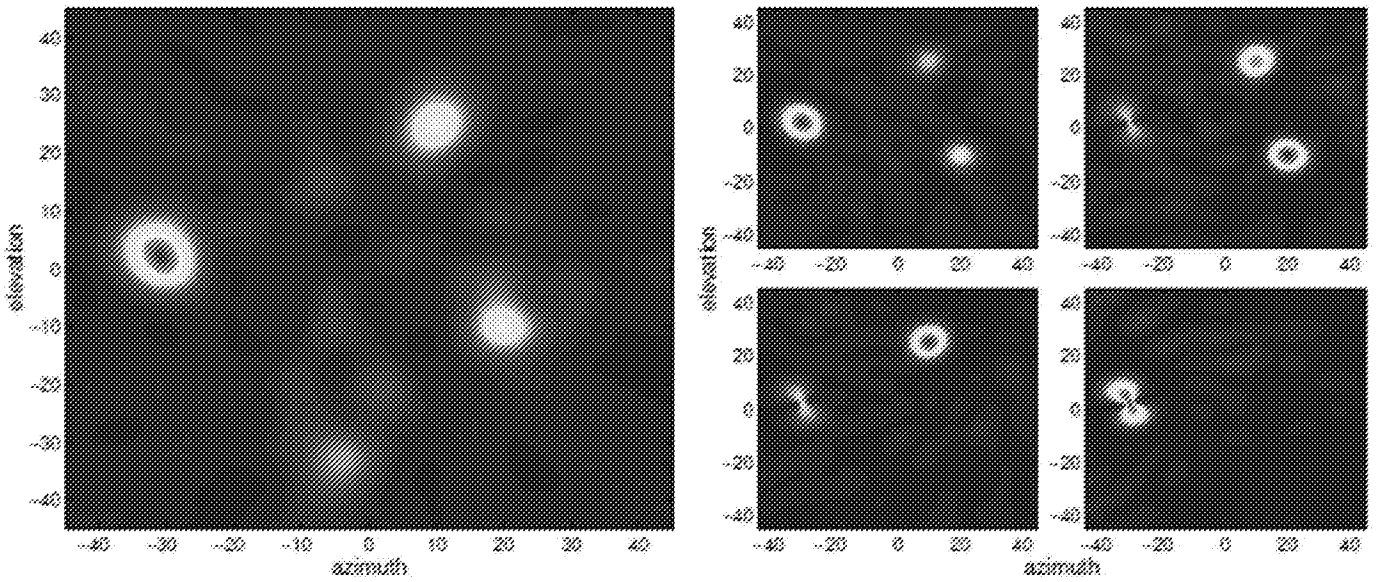
FIG. 7 shows spectrum functions for another experiment displayed as contour plots on a decibel (dB) scale.

FIG. 5A shows initial spectrum functions for experiments A (top) and B (bottom) plotted on a logarithmic scale, where MUSIC-1 refers to MUSIC with single-frame covariance estimation. FIG. 5B shows parametric plots of the true and computed source directions in experiment E. FIG. 5C shows a relative error (or residual) after each iteration of SDD in all synthetic experiments. FIG. 6 shows spectrum functions for experiment C displayed as contour plots on a dB scale. For SDD, the spectrum functions after 0, 1, 2, and 3 iterations are displayed left to right, top to bottom. FIG. 7 shows spectrum functions for experiment D displayed as contour plots on a dB scale. For SDD, the spectrum functions after 0, 1, 2, and 3 iterations are displayed left to right, top to bottom.

Experiment A:

A horizontal 16-element uniform linear array with element spacing of 0.1 meters records a single source at (20,0). The algorithms process a single frequency band corresponding to ~1.5 kHz (the wavelength is roughly twice array spacing), and evaluate their spectrum at 256 equally-spaced points corresponding to azimuths between −90 and 90 degrees for both display and peak searching.

Experiment B:

The configuration of this experiment is the same as that of experiment A, except the acoustic scene now consists of three sources located at (20,0), (−30,0), and (−60,0). An additional result was obtained with MUSIC using only a single frame for covariance estimation.

Experiment C:

Extending the previous experiments in both azimuth and elevation, a recording using a 64-element array with microphones arranged in an equally-spaced 8×8 grid with spacing of 0.02 meters is simulated. The scene consists of four sources at (20, −10), (10,25), (−30,0), and (−32,5). Note the close arrangement of two sources. Both algorithms process 20 frequency bands in the approximate frequency range 7.8 kHz-8.6 kHz, so that the wavelengths are between 2 and 3 times the array spacing. The spectrum functions are evaluated on a p×p grid corresponding to azimuths and elevations between −45 and 45 degrees, where p is 128 for MUSIC and 64 for SDD. For MUSIC, the sum of each individual band's spectrum is used.

Experiment D:

A more irregular array based on that of experiment E (FIG. 8) is implemented, with microphone spacing comparable to the grid array in experiment C. All other details of this experiment mirror that of experiment C.

Figure 8:
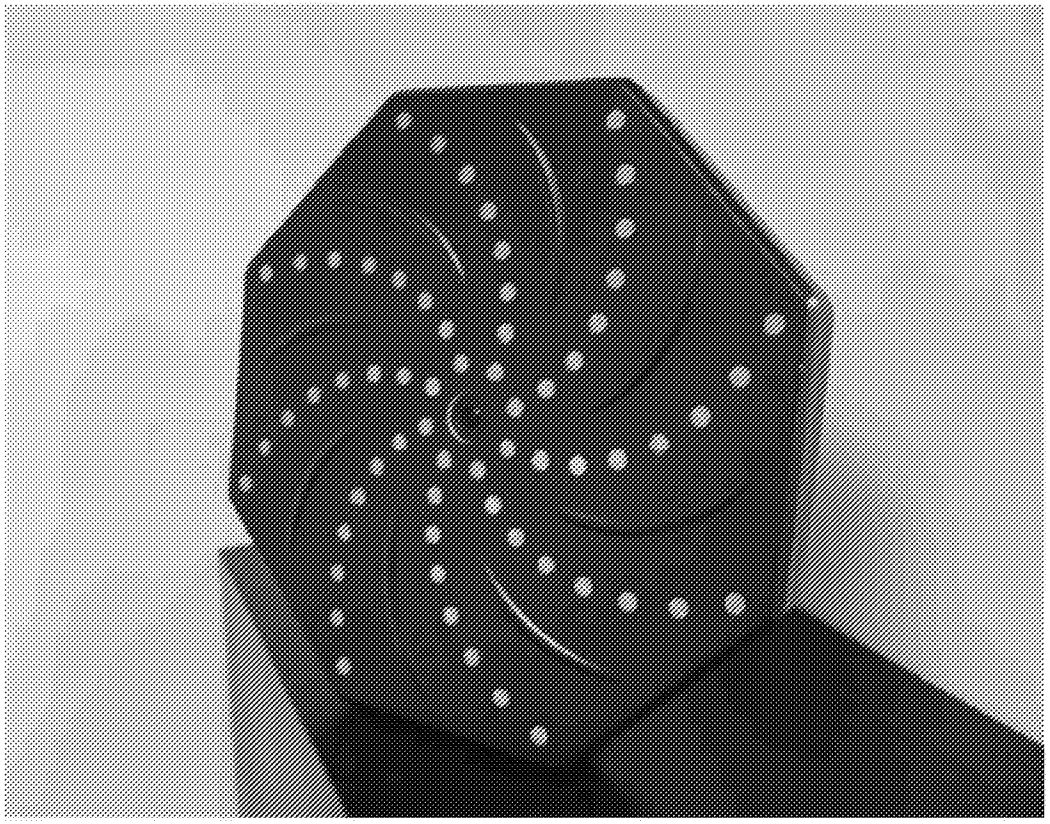
FIG. 8 shows a microphone array used in an experiment described herein.

Experiment E:

As a test of SDD's viability in practice, a 64-element array was used to record a moving source inside a room. 32 frames of these recordings were processed with SDD on 50 frequency bands in the 2.5 Hz-4 kHz frequency range. The SDD objective function was evaluated on a 32×32 grid over −45 to 45 degrees in azimuth and elevation. The array also recorded a video using a camera mounted in the array's center; as ground truth, incident angles were computed using the video frames corresponding to the processed frames. FIG. 8 shows the array used in experiment E.

FIG. 5A shows results of experiments A and B. From experiment A (top graph shown in FIG. 5A), it can be seen that the peak of SDD is similar to that of MUSIC for a single-source recording. For multi-source recordings, the initial spectrum of SDD is much flatter in comparison to MUSIC, and has much wider peaks. However, note that these peaks are not the actual peaks from which the DOA are derived by SDD: only the strongest peak is used at the first step of the algorithm. Peaks which are flat or even invisible at the initial steps become stronger and sharper in consequent steps after stronger peaks are removed. Experiment B (bottom graph in FIG. 5A) shows that the peaks of SDD at the first step of the algorithm are comparable in width to those of MUSIC when a single frame is used for covariance estimation.

FIGS. 6 and 7 similarly show that SDD was able to detect all four sources in experiments C and D, and show a noticeable difference in the MUSIC spectrums of these experiments: in experiment D, the MUSIC spectrum contains an extraneous peak near (−5,−30). Since the MUSIC method in this case assumes a signal subspace of rank 4, it can be inferred that the method was unable to distinguish between the close sources and treated them as one source. In comparison, there are no such extraneous peaks in the MUSIC spectrum for experiment C, suggesting that the method correctly accounted for all four sources. As SDD produced similar results in both experiments, this result suggests that SDD is less dependent on array geometry than MUSIC.

FIG. 5B plots the principal source directions computed by SDD and those computed as ground truth as a pair of curves parameterized by frame number. The curve for SDD travels in roughly the same path as the ground truth, albeit with some fluctuations. Such a result suggests that SDD is also applicable in real environments.

The relative error computed after each iteration of SDD in all synthetic experiments is now analyzed. As seen in FIG. 5C, if the error tolerance is set as ≈0.3, the method yields the correct number of sources in all experiments. Note that this tolerance is close to the relative amplitude of the −10 dB microphone self-noise. Thus setting an error tolerance can be set to be proportional to the magnitude of measurements not accounted by the SDD model for improved performance.

This algorithm is similar to classical MUSIC and its extensions. Some comparative systems relate to multi-frequency sources. However, no decomposition is performed there; instead, there are strong assumptions on the frequency content and numbers of sources. In contrast, the SDD algorithm is general.

It is also possible to pursue a representation that combines the leading planewaves/sources and the ambient field. To achieve this, the current algorithm may be extended to include near sources, and the residual after SDD/source estimation would be represented via a low-order ambisonics representation. Other possible uses include source localization/separation. Other embodiments relate to obtaining real time implementations and extending the algorithm to arrays on baffled objects.

It is important to note that the construction and arrangement of the various exemplary embodiments are illustrative only. Although only a few embodiments have been described in detail in this disclosure, those skilled in the art who review this disclosure will readily appreciate that many modifications are possible without materially departing from the teachings and advantages of the subject matter described herein. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

The following references are incorporated herein by reference in their entirety.

[1] R. Schmidt, "Multiple emitter location and signal parameter estimation," *IEEE Transactions on Antennas and Propagation*, vol. 34, no. 3, pp. 276-280, March 1986.

[2] A. O'Donovan, R. Duraiswami, J. Neumann. "Microphone arrays as generalized cameras for integrated audio visual processing," IEEE Conference on Computer Vision and Pattern Recognition, 2007. CVPR'07, 1-8.

[3] J. H. DiBiase, H. F. Silverman, and M. S. Brandstein, "Robust localization in reverberant rooms," in *Microphone Arrays: Signal Processing Techniques and Applications*, M. S. Brandstein and D. B. Ward, Eds., pp. 157-180. Springer Berlin Heidelberg, Berlin, Heidelberg, 2001.

[4] D. Kundu, "Modified MUSIC algorithm for estimation DOA of signals," *Signal Process*., vol. 48, no. 1, pp. 85-90, January 1996.

[5] B. Rafaely, 2004. Plane-Wave Decomposition of the Sound Field on a Sphere by Spherical Convolution, J. Acoust. Soc. Am., vol. 116(4), pp. 2149-2157.

[6] T. Terada, T. Nishimura, Y. Ogawa, T. Ohgane, and H. Yamada, "DOA estimation for multi-band signal sources using compressed sensing techniques with Khatri-Rao processing," *IEICE Transactions on Communications*, vol. E97.B, no. 10, pp. 2110-2117, 2014.

[7] D. N. Zokin, R. Duraiswami and N. A. Gumerov. "Plane-Wave Decomposition of Acoustical Scenes Via Spherical and Cylindrical Microphone Arrays," IEEE transactions on audio, speech, and language processing. 20(1):2-2, 2010.

What is claimed is:

1. A spatial-audio recording system comprising:

a processor; and instructions stored in a non-transient computer-readable medium that, when read by the processor, cause the processor to perform operations comprising:

retrieving audio data;

determining a recorded signal vector based on the audio data;

initializing values for an operator specific to a frequency; and determining a plurality of directions by performing operations comprising iteratively, until an exit condition is satisfied:

initializing or incrementing an index "i";

determining an ith direction using the operator; and updating the operator to correspond to an ith iteration using the equation:

$$L_n^{(i)} = L_n^{(i-1)} - \frac{L_n^{(i-1)} h_n(s_i) h_n^*(s_i) L_n^{(i-1)}}{h_n^*(s_i) L_n^{(i-1)} h_n(s_i)},$$

where $L_n^{(i-1)}$ is the operator corresponding to an (i−1)th iteration for an nth frequency, and $h_n(s_i)$ is a steering vector corresponding to the ith direction for an nth frequency.

2. The system of claim 1, further comprising a display configured to display a visual indicator corresponding to at least one of the determined plurality of directions, and wherein the instructions, when read by the processor, further cause the processor to provide data indicative of the at least one of the determined plurality of directions to the display.

3. The system of claim 1, further comprising a speaker configured to output an audio signal corresponding to an isolated audio signal, and wherein the instructions, when read by the processor, further cause the processor to isolate, from the audio data, an audio signal corresponding to one of the determined plurality of directions as the isolated audio signal.

4. The system of claim 1, wherein the steering vector $h_n(s_i)$ is a vector of length M having values that satisfy the equation $$h_n(s_i)_m = e^{-jk_n s_i r_m},$$

wherein j is the square root of negative one, M is a number of microphones in an array of microphones, $r_m$ specifies a location of an mth microphone of the array of microphones, $s_i$ specifies an ith direction, and $k_n$ is a wavenumber of a recorded signal having a frequency n.

5. The system of claim 1, wherein determining the ith direction using the operator comprises retrieving data for the operator corresponding to an (i−1)th iteration, and performing a minimization process on an objective function that is a function of the operator corresponding to the (i−1)th iteration.

6. The system of claim 5, wherein $\mathcal{F}^{(i)}(s_i)$ is the objective function that is a function of the operator corresponding to the (i−1)th iteration and $\mathcal{F}^{(i)}(s_i)$ satisfies the equation:

$$\mathcal{F}^{(i)}(s) = \sum_{n=1}^{N} w_n \|L_n^{(i)}(s) P_n\|_2^2 = \sum_{n=1}^{N} w_n P_n^* L_n^{(i)}(s) P_n,$$

where N is a total number of frequencies of interest, $P_n$ is a vector having values corresponding to signal measurements for the nth frequency made using an array of microphones, $w_n$ is an nth positive weight.

7. The system of claim 5, wherein the instructions, when read by the processor, further cause the processor to determine that the exit condition is satisfied by performing operations that include:

setting an error tolerance value;

determining a residual of the objective function; and determining that the residual of the objective function is less than or equal to the error tolerance value.

8. The system of claim 7, wherein determining the residual of the objective function is based on the equation:

$$\epsilon^{(i)} = \left(\frac{\mathcal{F}^{(i)}(s_i)}{\|P\|_2^2}\right)^{1/2}, \|P\|_2^2 = \sum_{n=1}^{N} w_n \|P_n\|_2^2, \|P_n\|_2^2 = P_n^* P_n,$$

where $\mathcal{F}^{(i)}(s_i)$ is the objective function corresponding to the ith iteration, N is a total number of frequencies of interest, $P_n$ is a vector having values corresponding to signal measurements for the nth frequency made using an array of microphones, and $w_n$ is an nth positive weight.

9. The system of claim 5, wherein the minimization process on the objective function is performed using methods that comprise a gradient method.

10. The system of claim 1, wherein retrieving data for the operator corresponding to an (i−1)th iteration comprises retrieving data for the operator generated during a previous iteration.

11. The system of claim 1, wherein the operator is expressed as a matrix determined by the processor.

12. The system of claim 11, wherein initializing the values for the operator is performed such that the initialized operator is an identity matrix.

13. A spatial-audio recording system, comprising:

a plurality of microphones comprising a number M of microphones;

a processor; and instructions stored in a computer-readable medium that, when read by the processor, cause the processor to perform operations comprising:

retrieving audio data recorded by the microphones;

determining a recorded signal vector based on the audio data;

initializing values for an operator, the operator being an M×M matrix; and determining a plurality of directions by performing operations comprising iteratively, until an exit condition is satisfied:

initializing or incrementing an index "i";

determining an ith direction using the operator by retrieving data for the operator corresponding to an (i−1)th iteration, and performing a minimization process on an objective function that is a function of the operator corresponding to the (i−1)th iteration, wherein the objective function satisfies the equation:

$$\mathcal{F}^{(i)}(s_i) = \sum_{n=1}^{N} w_n P_n^* \left( L_n^{(i-1)}(s_{i-1}) - \frac{I_n^{(i-1)}(s) I_n^{(i-1)*}(s)}{I_n^{(i-1)*}(s) I_n^{(i-1)}(s)} \right) P_n,$$

where N is a total number of frequencies of interest, $L_n^{(i-1)}(s_{i-1})$ is the operator corresponding to the (i−1)th direction for an nth frequency, $I_n^{(i-1)}(s)$ is defined as $L_n^{(i-1)}(s_{i-1}) h_n(s)$ and has M values, where $h_n(s)$ is a steering vector corresponding to the ith direction for the nth frequency, $P_n$ is a vector having M values corresponding to signal measurements for the nth frequency made by the M microphones, and is an nth positive weight; and updating the operator to correspond to an ith iteration.

14. The system of claim 13, further comprising a display configured to display a visual indicator corresponding to at least one of the determined plurality of directions, and wherein the instructions, when read by the processor, further cause the processor to provide data indicative of the at least one of the determined plurality of directions to the display.

15. The system of claim 13, further comprising a speaker configured to output an audio signal corresponding to an isolated audio signal, and wherein the instructions, when read by the processor, further cause the processor to isolate, from the audio data, an audio signal corresponding to one of the determined plurality of directions as the isolated audio signal.

16. A method of determining one or more sources of an audio signal, comprising:

retrieving audio data;

determining a recorded signal vector based on the audio data;

initializing values for an operator; and determining a plurality of directions by performing operations comprising iteratively, until an exit condition is satisfied:

initializing or incrementing an index "i";

determining an ith direction using the operator by retrieving data for the operator corresponding to an (i−1)th iteration, and performing a minimization process on an objective function that is a function of the operator corresponding to the (i−1)th iteration, wherein the objective function satisfies the equation:

$$\mathcal{F}^{(i)}(s_i) = \sum_{n=1}^{N} w_n P_n^* \left( L_n^{(i-1)}(s_{i-1}) - \frac{I_n^{(i-1)}(s) I_n^{(i-1)*}(s)}{I_n^{(i-1)*}(s) I_n^{(i-1)}(s)} \right) P_n,$$

where N is a total number of frequencies of interest, L_n^(i−1)(s_(i−1)) is the operator corresponding to the (i−1)th direction for an nth frequency, I_n((i−1))(s) is defined as L_n^((i−1))(s_(i−1))h_n(s) where "h"_n (s) is a steering vector corresponding to the ith direction for the nth frequency, "P" n is a vector having values corresponding to signal measurements for the nth frequency made using an array of microphones, and w_n is an nth positive weight; and updating the operator to correspond to an ith iteration.

17. The system of claim 16, further comprising:

providing data indicative of the at least one of the determined plurality of directions to a display device; and displaying, on the display device, a visual indicator corresponding to the determined plurality of directions.

18. The system of claim 16, further comprising:

isolating, from the audio data, an audio signal corresponding to one of the determined plurality of directions; and output an audio signal corresponding to the isolated audio signal.

19. A spatial-wave analysis system comprising:

a processor; and instructions stored in a non-transient computer-readable medium that, when read by the processor, cause the processor to perform operations comprising:

retrieving wave signal data;

determining a signal vector based on the wave signal data;

initializing values for an operator specific to a frequency;

determining a plurality of directions by performing operations comprising iteratively, until an exit condition is satisfied:

initializing or incrementing an index "i";

determining an ith direction using the operator; and updating the operator to correspond to an ith iteration by using the equation:

$$L_n^{(i)} = L_n^{(i-1)} - \frac{L_n^{(i-1)} h_n(s_i) h_n^*(s_i) L_n^{(i-1)}}{h_n^*(s_i) L_n^{(i-1)} h_n(s_i)},$$

where $L_n^{(i-1)}$ is the operator corresponding to an (i−1)th iteration for an nth frequency, and $h_n(s_i)$ is a steering vector corresponding to the ith direction for an nth frequency; and determining an isolated wave having one direction of the plurality of directions.

* * * * *